United States Patent [19]

Leuthy, Jr.

[11] 3,977,675

[45] Aug. 31, 1976

[54] PADDLE GAME APPARATUS

[76] Inventor: Henry R. Leuthy, Jr., 9672 Lindenbrook St., Fairfax, Va. 22030

[22] Filed: Nov. 13, 1975

[21] Appl. No.: 631,687

[52] U.S. Cl. ..... 273/85 D; 273/85 C

[51] Int. Cl.[2] ..... A63F 7/06

[58] Field of Search ..... 273/85, 94 R, 101, 95 R, 273/119 R

[56] References Cited

UNITED STATES PATENTS

| | | | |
|---|---|---|---|
| 2,215,687 | 9/1940 | Carter | 273/85 D |
| 3,466,042 | 9/1969 | Lucci | 273/85 A |
| 3,480,277 | 11/1969 | Fraser | 273/85 D |

FOREIGN PATENTS OR APPLICATIONS

| | | | |
|---|---|---|---|
| 69,521 | 7/1949 | Denmark | 273/85 D |
| 741,149 | 12/1932 | France | 273/85 D |
| 6,515,128 | 5/1967 | Netherlands | 273/85 D |
| 257,722 | 9/1926 | United Kingdom | 273/85 D |
| 415,260 | 8/1934 | United Kingdom | 273/85 C |

*Primary Examiner*—Richard C. Pinkham
*Assistant Examiner*—Harry G. Strappello
*Attorney, Agent, or Firm*—Bacon & Thomas

[57] ABSTRACT

A rectangular box defining a playing area has transverse barrier walls of less height than its side and end walls, spaced from each end wall to define goal areas and each barrier wall has an opening to define a scoring path. Slidable and rotatable paddle-carrying rods extend through the side walls between the barrier walls and the paddles are so dimensioned that a playing ball may be projected through the opening into a goal area or may be lifted and thrown over the barrier wall into a goal area.

4 Claims, 3 Drawing Figures

20
6
12
4
26
3
2
28
30
32
14
8
40
16
36
34
E
10
22
24

6
2
C
12
10
28
22
24
26
36
20
18
34
14
8
30
B
A
32
16
40
4

8
2
6

10
26
22
28
36
16
34
4
32
30
40

PADDLE GAME APPARATUS

BACKGROUND OF THE INVENTION

This invention is in the field of game apparatus providing competitive play between two or more participants.

Games have been proposed heretofore in which a playing field is defined by a box-like structure having goal openings at opposite ends, rods slidably and pivotally mounted in the side walls and having depending paddles thereon whereby a ball resting on the bottom surface of the box-like structure may be manipulated and projected along the bottom surface seeking to project the ball into one or the other of the goal openings. Patents describing devices of this type are the patents to Carter U.S. Pat. No. 2,215,687, May 3,574,350, French patent No. 758,915 and French patent No. 741,149. These devices, however, contemplate only movement of the game ball along the playing surface and they provide for scoring only by projecting the ball through one of the goal openings. The patent to Barbot et al 2,282,846 provides a similar device but, in addition, it has scoop-like paddle devices on certain of the rods whereby the game ball may be lifted and projected through the air seeking to project the same into an elevated basket-like goal, thus providing two alternative scoring means.

SUMMARY OF THE INVENTION

The present invention relates to a device of the general type referred to above but wherein all of the rods carry depending paddles and wherein a goal area may be entered by the game ball either through goal openings similar to those of the prior art or by projecting the same over a barrier wall in which the goal openings are provided, and into the same goal-scoring area.

It is, therefore, an object of this invention to provide a paddle game apparatus making possible the use of additional skills, beyond those required by the prior art.

It is a further object of this invention to provide a paddle game apparatus wherein a game ball may be projected into a scoring or goal area along different paths whereby different scoring rewards may be awarded.

Other objects and advantages will become apparent as the description proceeds with reference to the accompanying drawings.

DESCRIPTION OF A PREFERRED EMBODIMENT

Figure 1:
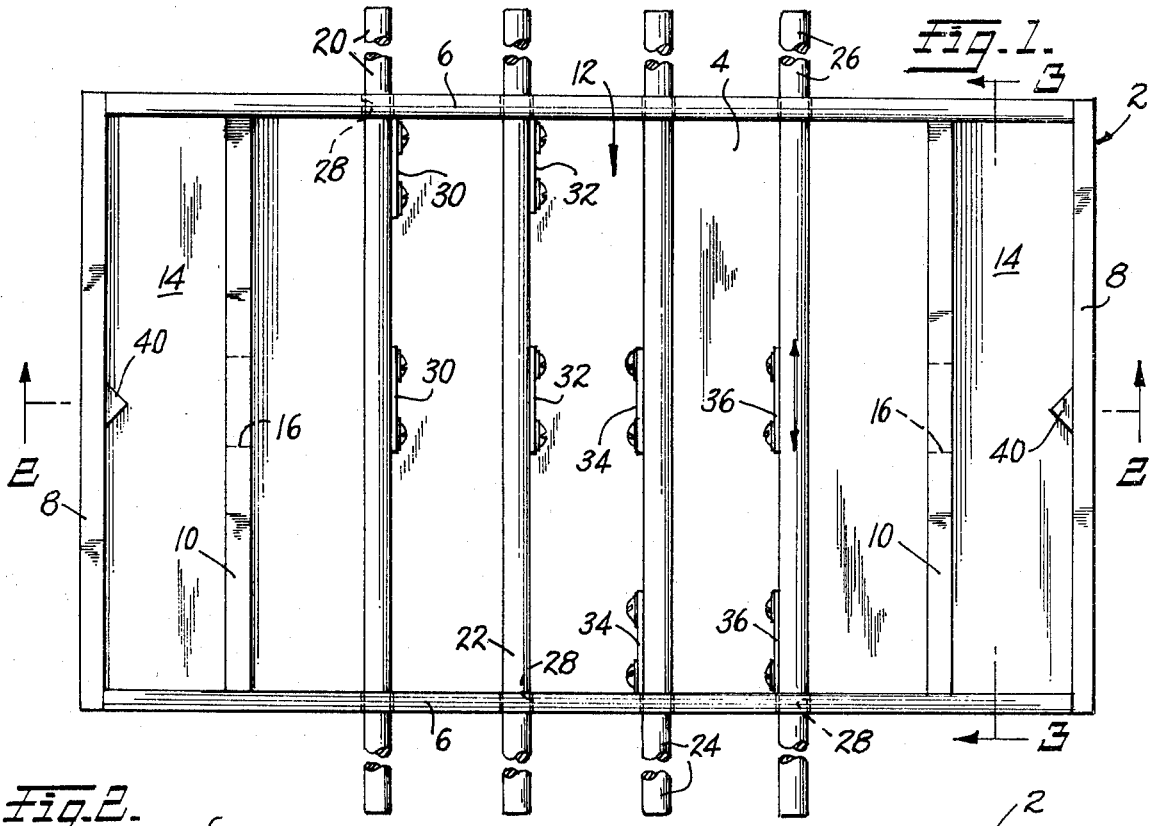
FIG. 1 is a top plan view of an apparatus embodying the present invention, with portions of the slide rods being omitted to facilitate illustration.

Numeral 2 designates generally a box-like structure comprising a bottom wall 4, opposed upstanding side walls 6 and opposed upstanding end walls 8. The side walls and end walls extend around the perimeter of the bottom wall 4 and thus define a playing area. Extending transversely across the interior of the box are barrier walls 10 of considerably less height than the side and end walls 6 and 8. Each of the barrier walls 10 extends completely across the interior of the box and thus divides the playing area into a central playing field 12 and goal areas 14 at opposite ends of the playing field. Each barrier wall 10 is provided with a goal opening 16 therethrough at the bottom edge thereof so that a game ball, such as the ball illustrated at 18, may be projected along the surface of the bottom wall 4 and through the goal opening 16 into a goal area 14 to constitute a score for a player, as will be more fully referred to later. It is to be noted that a ball 18 may be projected from the playing field 12 through the air over the barrier wall 10 into a goal area 14 since the top of the goal area is upwardly open.

A plurality of rods 20, 22, 24 and 26 extend loosely through openings 28 in side walls 6 and are both rotatable and slidable therein. Each rod is provided with a plurality of depending paddles 30, 32, 34 and 36, fixed thereon. The paddles 30 and 36 on rods 20 and 26 are so related to the spacing between the rods 20 and 22 and also 24 and 26 that the rods may be rotated through a complete revolution without having the paddles 30 or 36 engage either the barrier walls 10 or the adjacent rods 22 or 24. The paddles 32 and 34, however, are of sufficient length to engage the adjacent rods and are thus limited to swinging movement through approximately 180°. The dotted circles and arcs in FIG. 2 illustrate the range of movement of the respective paddles as described.

Figure 2:
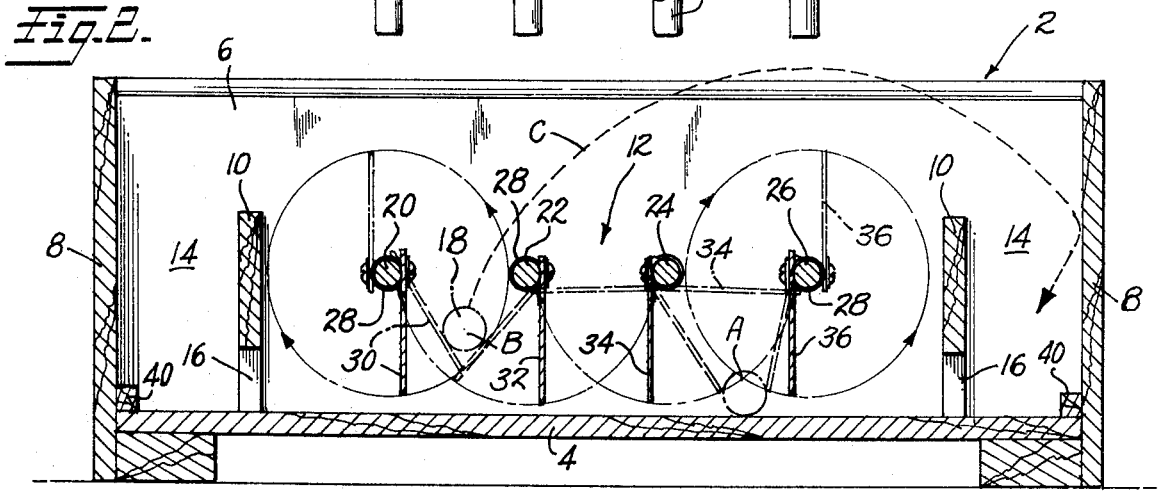
FIG. 2 is a vertical sectional view taken along the line 2—2 of FIG. 1.
Figure 3:
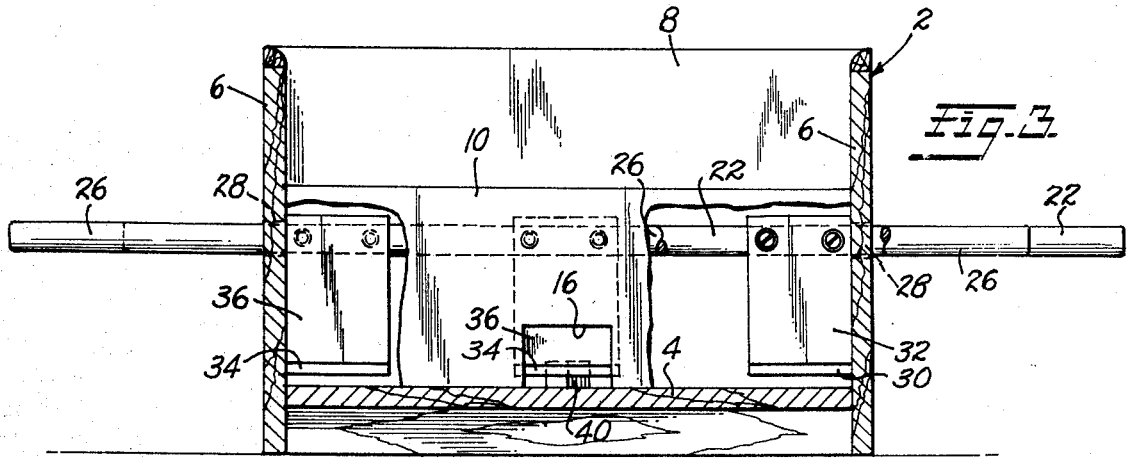
FIG. 3 is a transverse sectional view taken along the line 3—3 of FIG. 1 with portions being broken away to illustrate structure therebehind.

The spacing of the rods and the length of the paddles are also so interrelated that paddles on adjacent rods may be employed to simultaneously engage and manipulate a ball resting on the bottom wall 4, as indicated by dotted line at A, in FIG. 2. For example, a ball may be grasped between the two paddles and moved directly laterally of the playing field by a player manipulating the rods carrying those two paddles. Also, this feature permits "bouncing" a ball 18 back and forth along the bottom 4 between adjacent paddles which ultimately causes the ball to jump somewhat at which time the paddles may be swung together to hold the ball in an elevated position as shown at B in FIG. 2. By properly manipulating the rods on which those paddles are mounted, a player may project the ball 18 into the air and by further skillful manipulation of his paddles the ball may be projected along an arcuate path, such as that suggested in C at FIG. 2 in an effort to cause it to pass over the barrier wall 10 and enter a goal scoring area 14. The projection of a game ball through the air with the apparatus disclosed is possible although it requires much practice and exceptional skill and coordination to do so.

It is contemplated that a game constructed in accordance with the present invention shall contain a minimum of the four slide rods shown and already described, in which case two contestants may play the game. One contestant manipulates rods 20 and 22 and the other manipulates rods 24 and 26. Each player seeks to score a goal by causing the game ball to enter the goal area at the end of the box-like structure opposite from the goal adjacent the paddle rods he manipulates. However, it is possible for four to play the game wherein each player manipulates only a single slide rod, which requires exceptional coordination between adjacent players. It is also contemplated that the game may include additional pairs of slide rods, more than the four shown herein.

In view of the greater difficulty in effecting a score by projecting a ball through the air and over the barrier walls 10 than in projecting it through a goal opening 16, it is contemplated that the game will be played by awarding a greater number of points for a ball projected into the goal area over the barrier walls than the number of points awarded for causing the ball to enter through an opening 16.

The apparatus described above may be constructed of any suitable materials and it is contemplated that the ball 18 be of the type commonly used in the game of table tennis or Ping-Pong (TM).

As also shown, particularly in FIG. 1, each of the end walls 8 is provided with a generally triangular protuberance 40 on its inner surface, adjacent the bottom wall 4 and centrally aligned with the goal openings 16. Thus, any ball projected forcibly through an opening 16 with sufficient force to impinge the end wall 8 will encounter a portion of the protuberance 40 and be deflected thereby into the lateral regions of the goal area. In this manner, a ball projected through an opening 16 will not rebound off the wall 8 and back out of the opening 16. In this way a goal once scored cannot be lost by the ball rebounding out of the goal area.

While a single specific embodiment of the invention has been shown and described herein, the same is merely illustrative of the principles of applicant's game. Other forms and modifications may be resorted to within the scope of the appended claims.

I claim:

1. Game apparatus comprising:

means defining a playing area and having upstanding opposed side walls and end walls defining the perimeter thereof;

barrier walls extending between said side walls adjacent but spaced from each of said end walls and being of less height than said side and end walls to define an upwardly open goal area between each barrier wall and its adjacent end wall and a playing field between said barrier walls;

an opening through each barrier wall to define a scoring path from said playing field to each of said goal areas;

a plurality of paddle rods slidably and rotatably mounted in said side walls and having paddles fixed thereon; and a playing ball, the spacing between said paddle rods, the lengths of said paddles and the diameter of said ball being so related that paddles on adjacent rods may simultaneously engage said ball whereby a player may selectively manipulate said paddles to project said ball along said playing field through an opening in a barrier wall to a goal area or manipulate adjacent paddles to lift said ball from said playing field and project the same over a barrier wall into a goal area.

2. Game apparatus as defined in claim 1 wherein the paddle on at least one of said rods is of a length to engage adjacent rods when said one rod is rotated, and thereby limit rotation of said one rod to about 180 degrees, the paddle on said adjacent rod being of sufficiently short length to permit said adjacent rod to rotate through a complete revolution.

3. Game apparatus as defined in claim 2 wherein there are at least four of said paddle rods, those paddle rods nearest said barrier walls being said adjacent rods capable of being rotated through a complete revolution.

4. Game apparatus as defined in claim 1 wherein each of said end walls is provided with a protuberance aligned with the adjacent opening and shaped to laterally deflect a ball entering said goal area through said opening.

* * * * *